US008523400B2

(12) United States Patent
Lin et al.

(10) Patent No.: US 8,523,400 B2
(45) Date of Patent: Sep. 3, 2013

(54) LIGHT-EMITTING DIODE STREETLIGHT STRUCTURE

(75) Inventors: Wan-Chih Lin, Hsinchu (TW); Yi-Ming Tai, Hsinchu (TW); Cheng-Wei Yang, Hsinchu (TW); Chia-Wen Wu, Hsinchu (TW); Shun-Chih Chen, Hsinchu (TW)

(73) Assignee: Optotech Corporation, Hsinchu (TW)

( * ) Notice: Subject to any disclaimer, the term of this patent is extended or adjusted under 35 U.S.C. 154(b) by 167 days.

(21) Appl. No.: 12/965,128

(22) Filed: Dec. 10, 2010

(65) Prior Publication Data

US 2012/0106162 A1 May 3, 2012

(30) Foreign Application Priority Data

Oct. 27, 2010 (TW) ..... 99220808 U

(51) Int. Cl.
*F21V 29/00* (2006.01)

(52) U.S. Cl.
USPC ..... 362/294; 362/218; 362/267; 362/373; 362/396; 362/431; 362/153; 362/237; 362/240; 362/269; 362/287; 362/427

(58) Field of Classification Search
USPC ..... 362/218, 267, 294, 373, 396, 431, 362/153, 237, 240, 269, 287, 427
See application file for complete search history.

(56) References Cited

U.S. PATENT DOCUMENTS

| | | | | |
|---|---|---|---|---|
| 7,329,030 | B1 * | 2/2008 | Wang | 362/373 |
| 7,420,811 | B2 * | 9/2008 | Chan | 361/709 |
| 7,682,055 | B2 * | 3/2010 | Shuai et al. | 362/373 |
| 7,775,692 | B2 * | 8/2010 | Li | 362/431 |
| 8,007,128 | B2 * | 8/2011 | Wu et al. | 362/249.02 |
| 8,186,845 | B2 * | 5/2012 | Zheng | 362/183 |
| 2009/0310381 | A1 * | 12/2009 | Chang et al. | 362/555 |
| 2011/0128746 | A1 * | 6/2011 | Zheng | 362/373 |

* cited by examiner

*Primary Examiner* — Robert May
*Assistant Examiner* — Tsion Tumebo
(74) *Attorney, Agent, or Firm* — Rosenberg, Klein & Lee

(57) ABSTRACT

A light-emitting diode (LED) streetlight structure, which includes a light-emitting module, a power module, and a lamppost. The light-emitting module is disposed on side of the power module; the lamppost is disposed on the other side of the power module and corresponds to the light-emitting module. A heat-dissipating structure is disposed on the surface of a housing of the power module. The heat-dissipating structure corresponds to a power supply in the power module, and can dissipate the heat generated by the power supply and reduce the temperature thereof. Accordingly, heat dissipation of the power supply is enhanced, and hence increasing its lifetime.

15 Claims, 5 Drawing Sheets

LIGHT-EMITTING DIODE STREETLIGHT STRUCTURE

FIELD OF THE INVENTION

The present invention relates generally to a streetlight structure, and particularly to a light-emitting diode (LED) streetlight structure with excellent heat-dissipation and lighting performance.

BACKGROUND OF THE INVENTION

LEDs are diodes capable of emitting light when forward biased. They are light-emitting devices manufactured by semiconductor materials mostly including III-V chemical elements, such as gallium phosphide or gallium arsenide in the early days and aluminum-gallium-indium phosphide or gallium-indium nitride for high-brightness LEDs at present day. The light-emitting principle is to apply a current to the compound semiconductor. Then part of the energy will be released in the form of light via recombination of electrons and holes and thus achieving light-emitting effect.

Because the used materials are different, the energy levels of electrons and holes in LEDs differ. When the electrons and holes recombine, the released photons will hence have different energies, resulting in light with different wavelengths, which are light with different colors such as red, orange, yellow, green, blue, or invisible light.

Different from earlier light sources, LEDs are luminescent with low power consumption, long lifetime, no warm-up time, fast response, and small size. Besides, they are vibration tolerant, suitable for mass production, and easy to be manufactured extremely small or in arrays according to requirements of applications. Currently, LEDs are widely applied to indicators and displays of information, communication, and consumer electronic products, and thereby they have become indispensable important devices in daily lives.

As the LED technology becomes increasingly mature, its application areas are becoming wider. In the residence area, the applications include wall lamps, night lamps (the requirement in brightness for this application is not high, and thereby is the earliest application of LEDs), auxiliary lighting, garden lamps, and reading lamps. In the equipment area, the applications include emergency indicators and hospital bed lamps. In the store area, their applications include spotlights, embedded lamps, barrel lamps, and light bars. In the outdoor applications, LEDs can be used to decorate the appearance of buildings and used in solar-energy lamps. In addition, they can also applied to light shows.

The lighting market is long considered as the greatest and potential market of LEDs, even though no major lighting product is proposed owing to cost and performance limitations. However, it is undeniable that LED technology has been developing rapidly in recent years, making it to occupy some market in the special light market, such as the niche markets of freezer lighting, aviation lamps, or traffic lights). In the general lighting market, including barrel lamps, embedded lamps, spotlights, and landscape lighting products, some products start to replace traditional light sources such as halogen lamps or incandescent lamps.

At present, a heat dissipating structure is disposed below the LED module in an LED streetlight. It is because LEDs generate a huge amount of heat. If no heat dissipating structure is disposed, the lifetime of the LED module can be very possibly reduced owing to overheating. Besides, the lifetime of the power supply of the LED streetlight can be also substantially reduced caused by long-term overheating applications, and hence leading to frequent replacement of power supplies. Moreover, the lighting angle and direction of current LED streetlight are fixed, and therefore they cannot be adjusted according to the environment during installation.

Accordingly, the present invention provides an LED streetlight structure, which has a heat dissipating structure at the power supply and has a angle adjusting structure for the lamppost for improving heat dissipation of the power supply and changing the lighting angle and direction of the LED streetlight structure.

SUMMARY

An objective of the present invention is to provide an LED streetlight structure. According to the present invention, the housing contacting the power supply has a heat dissipating structure, which can dissipate the heat generated by the power supply and reduce the temperature thereof. Accordingly, heat dissipation of the power supply is enhanced, and hence increasing its lifetime.

Another objective of the present invention is to provide an LED streetlight structure having an angle adjusting structure. By means of the angle adjusting structure, the angle of a lamppost can be adjusted for changing the lighting angle and direction of the light emitted by the LED streetlight structure, and hence achieving an ideal lighting performance.

For achieving the objective described above, the present invention provides an LED streetlight structure comprising a light-emitting module, a power module, and a lamppost. The light-emitting module comprises at least a light-emitting apparatus and a heat-dissipating base, wherein the light-dissipating base is disposed in the heat-dissipating base. The power module is disposed on one side of the light-emitting module, and comprises a first housing, a second housing, a power supply, and a driving circuit board. The driving circuit board is disposed in the first housing; the power supply is disposed in the second housing. The driving circuit board connects to the power supply. The second housing is disposed in the first housing. The light-emitting apparatus connects to the driving circuit board. A heat-dissipating part is disposed on the surface of the second housing. The heat-dissipating part corresponds to the power supply and has a plurality of heat-dissipating fins. The lamppost is disposed on one side of the power module and corresponds to the light-emitting module.

The present invention also provides an LED streetlight structure comprising a light-emitting module, a power module, and a lamppost. The light-emitting module comprises at least a light-emitting apparatus and a heat-dissipating base, wherein the light-dissipating base is disposed in the heat-dissipating base. The power module is disposed on one side of the light-emitting module, and comprises a first housing, a second housing, a power supply, and a driving circuit board. The driving circuit board is disposed in the first housing; the power supply is disposed in the second housing. The driving circuit board connects to the power supply. The second housing is disposed in the first housing. The light-emitting apparatus connects to the driving circuit board. A heat-dissipating part is disposed on the surface of the second housing. The lamppost is disposed on one side of the power module and corresponds to the light-emitting module. An angle adjusting structure is disposed in the first housing of the power module. The lamppost is disposed slidably on the angle adjusting structure.

DETAILED DESCRIPTION

In order to make the structure and characteristics as well as the effectiveness of the present invention to be further understood and recognized, the detailed description of the present invention is provided as follows along with embodiments and accompanying figures.

Figure 1:
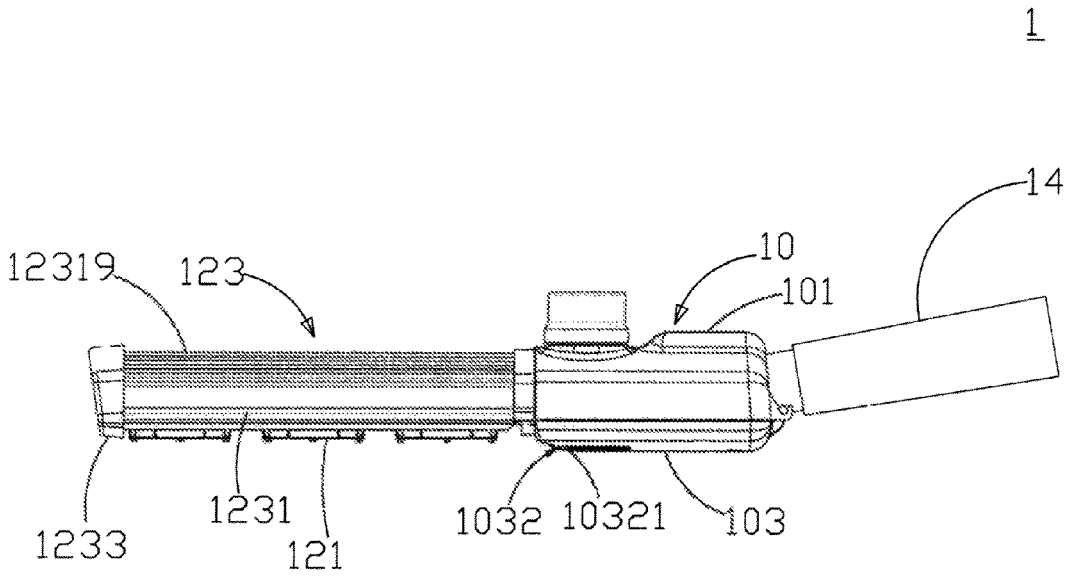
FIG. 1 shows a three-dimensional view of the LED streetlight structure according to a preferred embodiment of the present invention.
Figure 2:
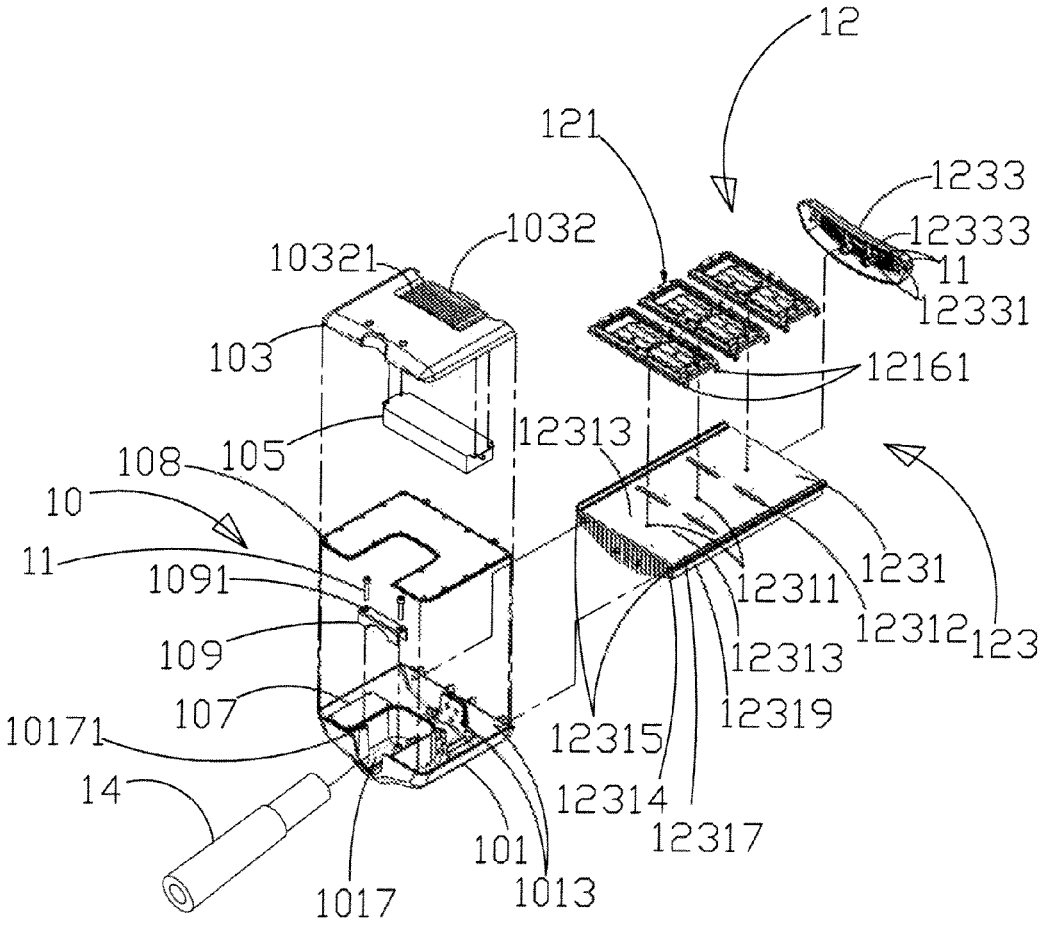
FIG. 2 shows an exploded view of the LED streetlight structure according to a preferred embodiment of the present invention.

FIG. 1 shows a three-dimensional view of the LED streetlight structure according to a preferred embodiment of the present invention. As shown in the figure, the present invention provides an LED streetlight structure 1, which comprises a power module 10, a light-emitting module 12, and a lamppost 14. The light-emitting module 12 is disposed on one side of the power module 10. The lamppost is disposed on the other side of the power module 10 and corresponds to the light-emitting module 12. FIG. 2 shows an exploded view of the LED streetlight structure according to a preferred embodiment of the present invention. As shown in the figure, the power module 10 comprises a first housing 101, a second housing 103, a power supply 105, and a driving circuit board 107. The power supply 105 is disposed in the second housing 103; the driving circuit board 107 is disposed in the first housing 101. The power supply 105 described above can be fixed in the second housing 103 using fasteners; the driving circuit board 107 can also be fixed in the first housing 101 using fasteners. When the power supply 105 and the driving circuit board 107 of the power module are damaged, it is only necessary to disassemble and replace the power supply 105 and the driving circuit board 107 without replacing the whole power module 10.

The power supply 105 connects to the driving circuit board 107, which, in turn, connects to the light-emitting module 12. The second housing 103 having the power supply 105 is disposed in the first housing 101 having the driving circuit board 107. In order to avoid moisture from entering the power module 10, the power module 10 according to the present embodiment further comprises a washer 108 disposed between the first and the second housings 101, 103 for increasing closeness therebetween.

A heat-dissipating part 1032 is disposed on the outer surface of the second housing 103. The heat-dissipating part 1032 is composed by a plurality of heat-dissipating fins 10321. Besides, the heat-dissipating part 1032 corresponds to the power supply 105. When the power supply 105 is used for a long time, it will generate heat. The heat-dissipating part 1032 can dissipate the heat generated by the power supply 105 effectively and lowering the temperature of the power supply 105, and hence increasing the lifetime of the power supply 105. A general LED streetlight does not have the heat-dissipating part disposed at the location of the power supply, and thereby overheating phenomenon occurs when the power supply is used form long time, which will shorten the lifetime of the power supply. The LED streetlight structure 1 according to the present invention has improved the problem described above.

Figure 3:
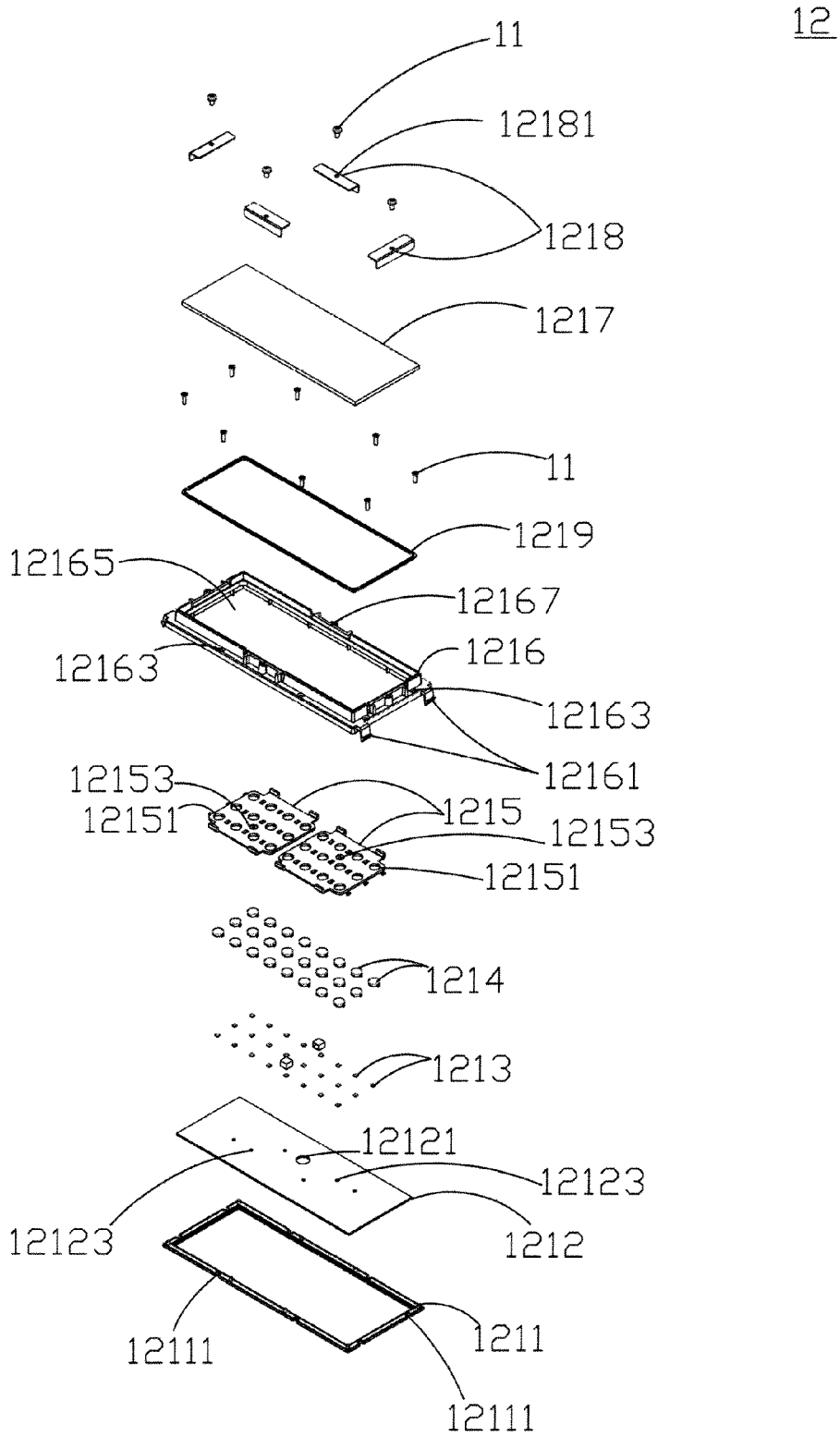
FIG. 3 shows an exploded view of the light-emitting apparatus according to a preferred embodiment of the present invention.

FIG. 3 shows an exploded view of the light-emitting apparatus according to a preferred embodiment of the present invention. As shown in the figure, the light-emitting module 12 comprises at least a light-emitting apparatus 121 and a heat-dissipating base 123. The light-emitting apparatus 121 is disposed on the heat-dissipating base 123. The light-emitting apparatus 121 includes a base 1211, a circuit board 1212, a plurality of LEDs 1213, a plurality of lenses 1214, two lens frames 1215, a frame 1216, and a glass sheet 1217. The heat-dissipating base 123 includes a heat-dissipating body 1231 and a heat-dissipating cover 1233.

The circuit board 1212 is disposed on the base 1211 and connects with the driving circuit board 107 of the power module 10. There is a first positioning hole 12121 at the center of the circuit board 1212. The heat-dissipating body 1231 has a first fixing hole 12311, which corresponds to the first positioning hole of the circuit 1212. Then, a fixing member 11 (not shown in the figure) is used for passing through the first positioning hole 12121 of the circuit board 1212. The fixing member 11 is fastened to the first fixing hole 12311 of the heat-dissipating body 1231. Thereby, the circuit board 1212 is fixed on the heat-dissipating body 1231.

The plurality of LEDs 1213 are disposed on the circuit board 1212 and connect electrically to a plurality of contacts (not shown in the figure). The plurality of lenses 1214 are disposed on the corresponding LEDs 1213, respectively. The two lens frames 1214 have a plurality of bores 12151, which are arranged according to the locations of the plurality of LEDs 123 having the plurality of lenses 1214. Each bore 12151 corresponds to an LED 1213 among the plurality of LEDs 1213. Each of the two lens frames 1215 has a positioning hole 12153, respectively. The circuit board 1212 has two first holes 12123 corresponding to the two positioning holes 12153. The heat-dissipating body 1231 has two second fixing holes 12313 corresponding to the two first holes 12123 of the circuit board 1212. Two fixing members (not shown in the figure) pass through the two positioning holes 12143 corresponding to the two lens frames 1214 and the two first holes 12123 of the circuit board 1212. The two fixing members are fastened to the two second fixing holes 12313 corresponding to the heat-dissipating body 1231. Hence, the positions of the two lens frames 1215 can be fixed.

The frame 1216 is fixed on the heat-dissipating body 1231 and accommodates the base 1211, the circuit board 1212, the plurality of LEDs 1213, the plurality of lenses 1214, and the two lens frames 1215. At least a sliding block 12161 is disposed on each sides of the frame 1216. A sliding trench 12315 is disposed on each side of the heat-dissipating body 1231. The plurality of sliding blocks 12161 on both sides of the frame 1216 slide into the corresponding sliding trenches 12315, respectively. The frame 1216 moves to the location above the base 1211, the circuit board 1212, the plurality of LEDs 1213, the plurality of lenses 1214, and the two lens frames 1215. A plurality of positioning holes 12163 are disposed on the periphery of the frame 1216; a plurality of holes 12111 are disposed on the periphery of the base 1211. The plurality of holes 12111 correspond to the plurality of positioning holes 12163. The heat-dissipating body 1231 has a plurality of third positioning holes 12317 corresponding to the plurality of holes 12111 of the base 1211. The plurality of fixing members 11 are fastened to the corresponding plurality of third fixing holes 12317 of the heat-dissipating body 1231, and hence fixing the position of the frame 1216.

The frame 1216 has an opening 12165, and the glass sheet 1217 is disposed at the opening 12165 of the frame 1216. For avoiding the glass sheet 1217 from escaping the opening 12165 of the frame 1216, the light-emitting apparatus 121 according to the present invention further has four pressure plates 1218 disposed at the four sides of the opening 12165 of the frame 1216. When the glass sheet 1217 is disposed at the opening 12165 of the frame 1216, the four pressure plates 1218 press the glass sheet 1217 and securing the frame 1216. Thereby, the glass sheet 1217 can be fixed, avoiding it from escaping the opening 12165 of the frame 1216. In the following, how the four pressure plates 1218 are fixed on the frame 1216 is described. Each pressure 1218 has a positioning hole 12181. A fixing hole 12167 is disposed on each side of the opening 12165 of the frame 1216. Then, four positioning members 11 are used for passing through the positioning hole 12181 of the pressure plate 1218 and fastened at the corresponding fixing hole 12167 of the frame 1216. Accordingly, the four pressure plates 1218 are secured on the frame 1216.

In order to prevent exterior moisture from entering the light-emitting apparatus 121, au/usher 1219 is further disposed between the glass sheet 1217 and the opening 12165 of the frame 1216 for increasing closeness therebetween and thus preventing exterior moisture from entering the light-emitting apparatus 121.

The heat-dissipating body 1231 of the heat-dissipating base 123 has a plurality of heat-dissipating fins 12319. By taking advantage of the large areas of the plurality of heat-dissipating fins 12319 for increasing heat-dissipating areas, the heat generated by the light-emitting apparatus 121 can be dissipated, and hence the temperature of the light-emitting apparatus 12 and enhancing the lifetime and light-emitting efficiency of the light-emitting apparatus 121.

The heat-dissipating cover 1233 of the heat-dissipating base 123 is disposed at on end of the heat-dissipating body 1231 and corresponds to the power module 10. The heat-dissipating cover 1233 has a plurality of positioning holes 12331. The heat-dissipating body 1231 also has a plurality of fourth fixing holes (not shown in the figure) at one end. The plurality of fourth fixing holes correspond to the plurality of positioning holes 12331 of the heat-dissipating cover 1233. Then pass the plurality of fixing members 11 through the corresponding the plurality of positioning holes 12331 of the heat-dissipating cover 1233 and fasten them to the plurality of fourth fixing holes of the heat-dissipating body 1231. The heat-dissipating cover 1233 also has a plurality of heat-dissipating holes 12333 for improving heat dissipation of the heat-dissipating base 123 effectively.

Refer again to FIGS. 1 to 3. The power module 10 is disposed on one side of the light-emitting module 12. The connection between the power module 10 and the light-emitting module 12 is described as follows. The first housing 101 of the power module 10 has a plurality of positioning holes 1013 on the surface adjacent to the light-emitting module 12. The heat-dissipating body 1231 of the light-emitting module has a plurality of fifth fixing holes 12314 on the surface adjacent to the power module 10. A plurality of fixing members (not shown in the figure) pass through the corresponding plurality of positioning holes 1013 of the first housing 101 of the power module 10 and are fastened to the corresponding plurality of fifth fixing holes 12314 of the heat-dissipating body 1231 of the light-emitting module 12. When the power module 10 or the light-emitting module is damaged, only the power module 10 or the light-emitting module has to be replaced, not necessary to replace the whole LED streetlight structure 1.

The lamppost 14 is disposed on the other side of the power module 10 and corresponds to the light-emitting module 12. The first housing 101 of the power module 10 has an assembly cavity 1017; the lamppost 14 is disposed in the assembly cavity 1017. The power module 10 further includes a limiter 109, which is sawtooth-shaped and located on the lamppost 14, and is fixed in the assembly cavity 1017 of the first housing 101. A positioning hole 1091 is disposed on each of the both ends of the limiter 109, respectively. Two fixing holes 10171 are disposed in the assembly cavity 1017 and correspond to the two positioning holes 1091 of the limiter 109. The two fixing members 11 pass through the corresponding two positioning holes 1091 of the limiter 109, and are fastened to the corresponding two fixing holes 10171 of the assembly cavity 1017. Thereby, the limiter 109 is secured in the assembly cavity 1017 and is located on the lamppost 14. The limiter 109 limits the lamppost 14 in the assembly cavity 1017 of the first housing 101.

Figure 4:
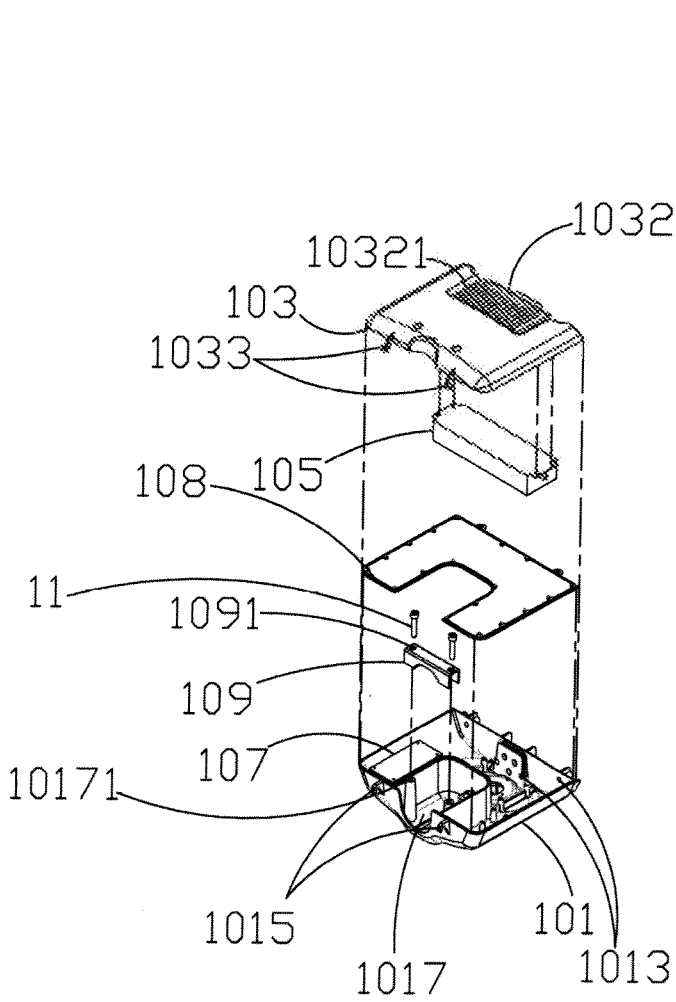
FIG. 4 shows an exploded view of the power module according to another preferred embodiment of the present invention.

FIG. 4 shows an exploded view of the power module according to another preferred embodiment of the present invention. According to the embodiment described above, the power module 10 of the power module 10 is disposed on the first housing 101. The present embodiment further discloses that the second housing 103 can be lifted using one side of the first housing 101 as the pivot and can be disassembled from the first housing 101 for easy replacement of the power supply 105 disposed in the housing 103 in the future. The first housing 101 has at least a hook member 1015 on the side away from the light-emitting module 12; the second housing 103 has at least a buckle member 1033 on the side away from the light-emitting module 12. The plurality of buckle members 1033 of the second housing 103 are hooked by the corresponding plurality of hook members 1015 of the first housing 101. Thereby, the number of components for securing the first and second housings 101, 103 is reduced.

When repairing and maintaining the power supply 105 of the power module 105, one only needs to lift the second housing 103 and disassemble the second housing 103 having the power supply 105 from the first housing 101 for repairing and maintaining the power supply 105 and the driving circuit board 107 in the power module 10. While lifting the second housing 103, the plurality of buckle members 1033 of the second housing 103 rotate in the corresponding plurality of hook members 1015 for lifting the second housing 103. Then the plurality of buckle members 1033 of the second housing 103 is forced to escape from the plurality of hook members 1015 of the first housing 101 for easy repair of the power supply 105 disposed in the second housing 103. After repair, assemble the second housing 103 to the first housing 101. Thereby, no high-up-in-the-air repair is required, and hence reducing danger in repairing.

Figure 5:
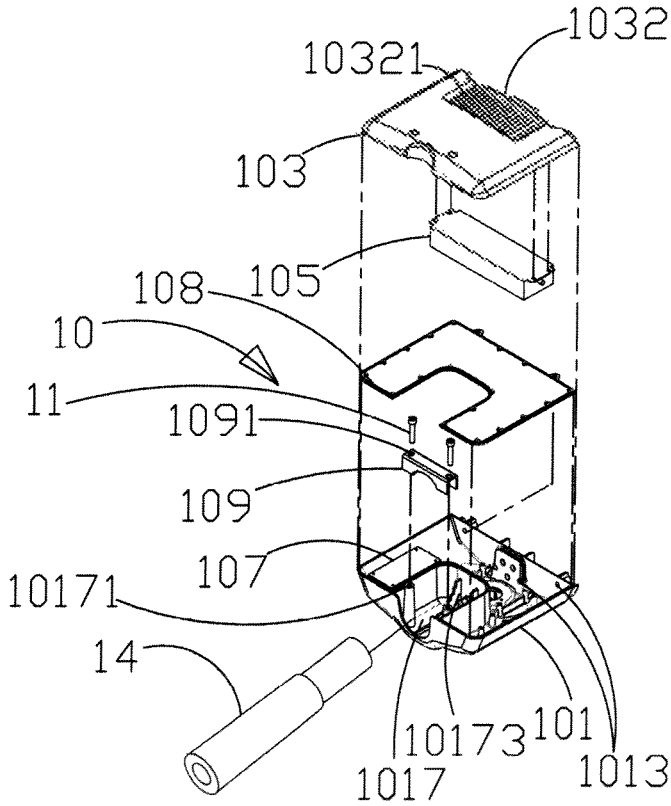
FIG. 5 shows an exploded view of the power module and the lamppost according to another preferred embodiment of the present invention.

FIG. 5 shows an exploded view of the power module and the lamppost according to another preferred embodiment of the present invention. As shown in the figure, the difference between the present embodiment and the previous one is that the LED streetlight structure 1 according to the present embodiment can change the lighting angle and direction of the light emitting by the light-emitting module 12 by adjusting the angle of the lamppost 14. The assembly cavity 1017 in the first housing 101 of the power module 10 according to the present embodiment has an angle adjusting structure 10173, which is sawtooth-shaped. The lamppost 14 is disposed in the assembly cavity 1017; the lamppost 14 is slidably disposed on the angle adjusting structure 10173. By adjusting the angle of the lamppost 14 via the angle adjusting structure 10173, the lighting angle and direction of the light emitted by the light-emitting module 12 can be adjusted correspondingly.

The present invention provides an LED streetlight structure. The power module of the LED streetlight structure according to the present invention has the heat-dissipating part composed of the plurality of heat-dissipating fins. The heat-dissipating part dissipates the heat generated by the power supply in the power module, and hence enhancing heat dissipation of the power module and lifetime of the power supply.

The power module of the LED streetlight structure according to the present invention has the first and second housings. The second housing can be lifted and disassembled for easily repairing the power supply disposed in the second housing. After repair, assemble the second housing to the first housing. Thereby, no high-up-in-the-air repair is required, and hence reducing danger in repairing.

The power module of the LED streetlight structure according to the present invention has the angle adjusting structure. By adjusting the angle of the lamppost via the angle adjusting structure, the lighting angle and direction of the light emitted by the light-emitting module can be adjusted correspondingly, and hence achieving an ideal lighting performance.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A light-emitting diode streetlight structure, comprising:

a light-emitting module, comprising at least a light-emitting apparatus and a heat-dissipating base, said light-emitting apparatus disposed on said heat-dissipating base;

a power module, disposed on one side of said light-emitting module, comprising a first housing, a second housing, a power supply, and a driving circuit board, said driving circuit board disposed in said first housing, said power supply disposed in said second housing, said driving circuit board connected to said power supply, said second housing disposed in said first housing, said light-emitting apparatus connected to said driving circuit board, said second housing having a heat-dissipating part on its surface, and said heat-dissipating part corresponding to said power supply and having a plurality of heat-dissipating fins; and a lamppost, disposed on one side of said power module, and corresponding to said light-emitting module;

wherein said heat-dissipating base comprises:

a heat-dissipating body, disposed on one side of said power module and having a plurality of heat-dissipating fins and a plurality of heat-dissipating holes, said heat-dissipating body having a sliding trench on each of both sides, respectively; a frame having at least a sliding block on each of both sides, respectively; said sliding block corresponding to said sliding trench on each of both sides of said heat-dissipating body, and said sliding block slidably disposed in said sliding trench on each of both sides of said heat-dissipating body; and a heat-dissipating cover, disposed on the other side of said heat-dissipating body, corresponding to said heat-dissipating body, and having a plurality of heat-dissipating holes.

2. The light-emitting diode streetlight structure of claim 1, wherein said light-emitting apparatus comprises:

a base, disposed in said heat-dissipating body;

a circuit board, disposed on said base; a plurality of light-emitting diodes, disposed on said circuit board;

a plurality of lenses, disposed on said corresponding light-emitting diodes, respectively;

at least a lens frame, disposed on said circuit board, having a plurality of bores corresponding to said plurality of light-emitting diodes having said plurality of lenses;

a frame, disposed on said heat-dissipating body, accommodating said base, said circuit board, said plurality of light-emitting diodes, said plurality of lenses, and said lens frame, and having an opening;

a glass sheet, disposed on said opening of said frame; and a plurality of pressure plates, disposed at the periphery of said glass sheet, and fixed on said frame for fixing said glass sheet on said opening of said frame.

3. The light-emitting diode streetlight structure of claim 2, wherein said light-emitting apparatus further comprises a washer disposed between said opening of said frame and said glass sheet.

4. The light-emitting diode streetlight structure of claim 1, wherein said first housing has a plurality of hook members on the side away from said light-emitting module; said second housing has a plurality of buckle members on the side away from said light-emitting module; and said plurality of buckle members are hooked by said corresponding plurality of hook members, respectively.

5. The light-emitting diode streetlight structure of claim 1, wherein said first housing has an assembly cavity, and said lamppost is disposed in said assembly cavity.

6. The light-emitting diode streetlight structure of claim 5, wherein said power module further comprises a limiter, located on said lamppost, fixed in said assembly cavity, and sawtooth-shaped.

7. The light-emitting diode streetlight structure of claim 1, wherein said power module further comprises a washer disposed between said first housing and said second housing.

8. A light-emitting diode streetlight structure, comprising:

a light-emitting module, comprising at least a light-emitting apparatus and a heat-dissipating base, said light-emitting apparatus disposed on said heat-dissipating base;

a power module, disposed on one side of said light-emitting module, comprising a first housing, a second housing, a power supply, and a driving circuit board, said driving circuit board disposed in said first housing, said power supply disposed in said second housing, said driving circuit board connected to said power supply, said second housing disposed in said first housing, and said light-emitting apparatus connected to said driving circuit board; and a lamppost, disposed on one side of said power module, corresponding to said light-emitting module, said first housing of said power module having an angle adjusting structure, and said lamppost slidably disposed on said angle adjusting structure;

wherein said heat-dissipating base comprises:

a heat-dissipating body, disposed on one side of said power module and having a plurality of heat-dissipating fins and a plurality of heat-dissipating holes, said heat-dissipating body having a sliding trench on each of both sides, respectively; said frame having at least a sliding block on each of both sides, respectively; said sliding block corresponding to said sliding trench on each of both sides of said heat-dissipating body, and said sliding block slidably disposed in said sliding trench on each of both sides of said heat-dissipating body; and a heat-dissipating cover, disposed on the other side of said heat-dissipating body, corresponding to said heat-dissipating body, and having a plurality of heat-dissipating holes.

9. The light-emitting diode streetlight structure of claim 8, wherein said light-emitting apparatus comprises:

a base, disposed in said heat-dissipating body;

a circuit board, disposed on said base;

a plurality of light-emitting diodes, disposed on said circuit board;

a plurality of lenses, disposed on said corresponding light-emitting diodes, respectively;

at least a lens frame, disposed on said circuit board, having a plurality of bores corresponding to said plurality of light-emitting diodes having said plurality of lenses;

a frame, disposed on said heat-dissipating body, accommodating said base, said circuit board, said plurality of light-emitting diodes, said plurality of lenses, and said lens frame, and having an opening;

a glass sheet, disposed on said opening of said frame; and a plurality of pressure plates, disposed at the periphery of said glass sheet, and fixed on said frame for fixing said glass sheet on said opening of said frame.

10. The light-emitting diode streetlight structure of claim 9, wherein said light-emitting apparatus further comprises a washer disposed between said opening of said frame and said glass sheet.

11. The light-emitting diode streetlight structure of claim 8, wherein said first housing has a plurality of hook members on the side away from said light-emitting module; said second housing has a plurality of buckle members on the side away from said light-emitting module; and said plurality of buckle members are hooked by said corresponding plurality of hook members, respectively.

12. The light-emitting diode streetlight structure of claim 8, wherein said first housing has an assembly cavity; said angle adjusting structure is disposed in said assembly cavity; and said lamppost is disposed in said assembly cavity and slidably disposed on said angle adjusting structure.

13. The light-emitting diode streetlight structure of claim 12, wherein said power module further comprises a limiter, located on said lamppost, fixed in said assembly cavity, and sawtooth-shaped.

14. The light-emitting diode streetlight structure of claim 8, wherein said angle adjusting structure is sawtooth-shaped.

15. The light-emitting diode streetlight structure of claim 8, wherein said power module further comprises a washer disposed between said first housing and said second housing.

* * * * *